United States Patent [19]

Gurubatham

[11] 4,424,431

[45] Jan. 3, 1984

[54] TURNTABLE DRIVE FOR A MICROWAVE OVEN

[75] Inventor: Vincent P. Gurubatham, St. Joseph Township, Berrien County, Mich.

[73] Assignee: Whirlpool Corporation, Benton Harbor, Mich.

[21] Appl. No.: 336,769

[22] Filed: Jan. 4, 1982

[51] Int. Cl.[3] ..... H05B 6/78

[52] U.S. Cl. ..... 219/10.55 F; 219/10.55 E; 219/10.55 R

[58] Field of Search ..... 219/10.55 R, 10.55 E, 219/10.55 F

[56] References Cited

U.S. PATENT DOCUMENTS

| | | | |
|---|---|---|---|
| 2,765,024 | 10/1956 | Brundage | 155/14 |
| 2,778,911 | 1/1957 | Valentine | 219/10.55 F |
| 2,782,292 | 2/1957 | Long | 219/35 |
| 2,827,537 | 3/1958 | Haagenson | 219/10.55 |
| 3,271,552 | 9/1966 | Krajewski | 219/10.55 |
| 3,300,615 | 1/1967 | Smith | 219/10.55 F |
| 3,744,403 | 7/1973 | Castronuovo | 99/421 |
| 4,131,778 | 12/1978 | Tanaka et al. | 219/10.55 F |
| 4,210,794 | 7/1980 | Oguri | 219/10.55 F |
| 4,225,767 | 9/1980 | Hatanaka et al. | 219/10.55 F |
| 4,286,133 | 8/1981 | Einset et al. | 219/10.55 F |
| 4,335,292 | 6/1982 | Tanaka et al. | 219/10.55 F |

FOREIGN PATENT DOCUMENTS

| | | | |
|---|---|---|---|
| 1081795 | 7/1980 | Canada | 219/10.55 F |
| 2618603 | 11/1976 | Fed. Rep. of Germany | 219/10.55 F |

*Primary Examiner*—B. A. Reynolds
*Assistant Examiner*—M. M. Lateef
*Attorney, Agent, or Firm*—Wood, Dalton, Phillips, Mason & Rowe

[57] ABSTRACT

A turntable drive for a microwave oven having a flexible shaft driven by the fan motor of the generator. The flexible shaft is connected to a mechanism carrying the food support. The operation of the mechanism by the shaft causes the support to have a desired movement in the oven cavity, which includes both lateral translation and rotation of the support. Structure is included permitting the manual movement of the support for facilitated placement of the food thereon by the user. The mechanism and support are mounted to a carrier which is slidably mounted for selective positioning within the oven cavity and forwardly therefrom as for placement of food on the support.

14 Claims, 9 Drawing Figures

FIG. 1
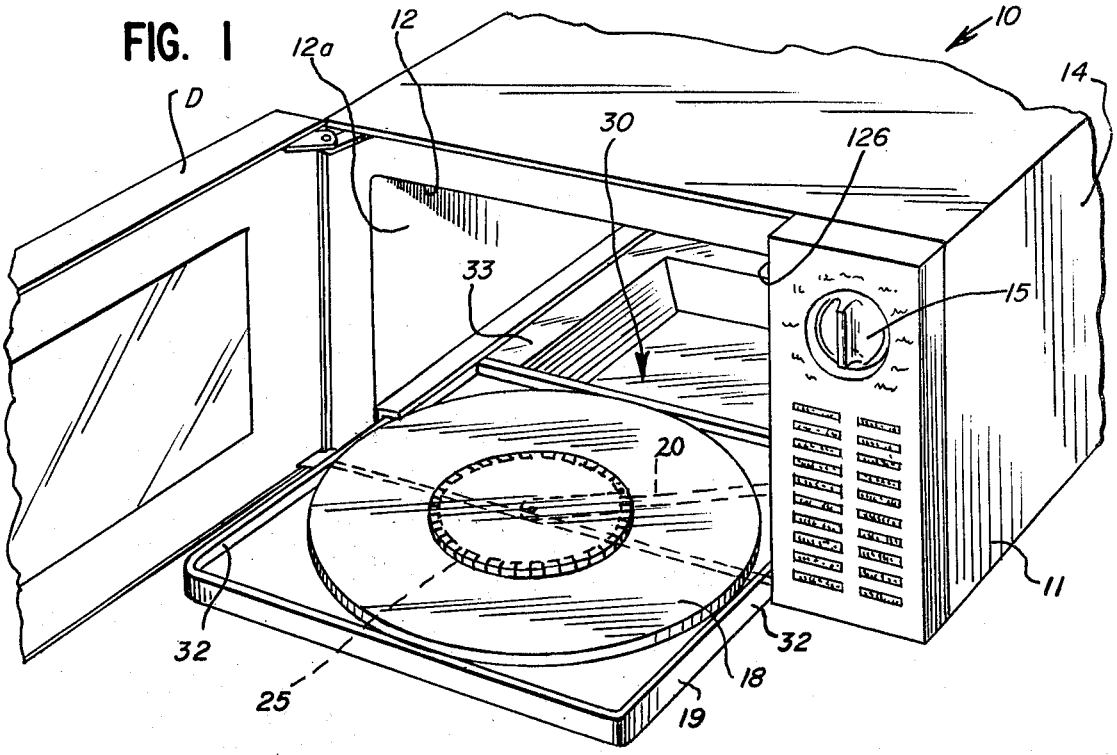
FIG. 2
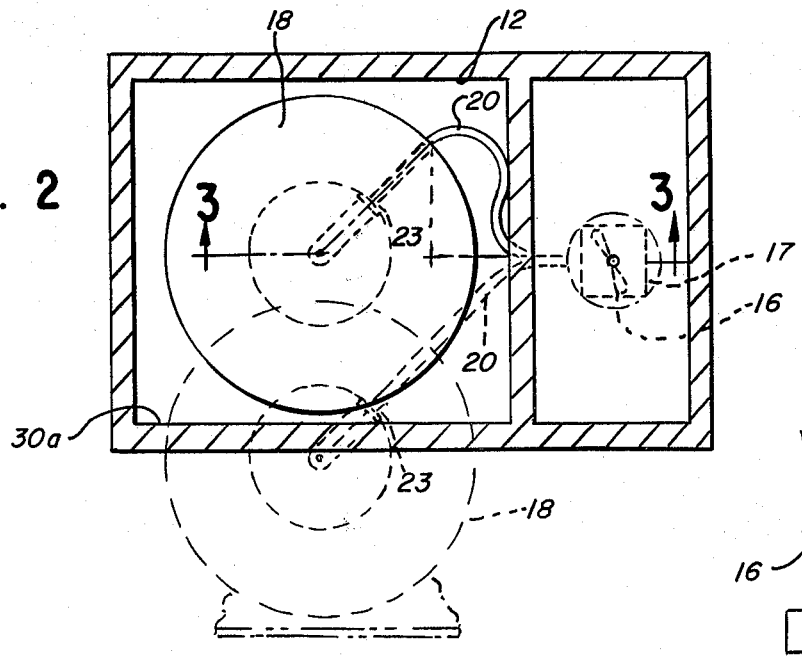
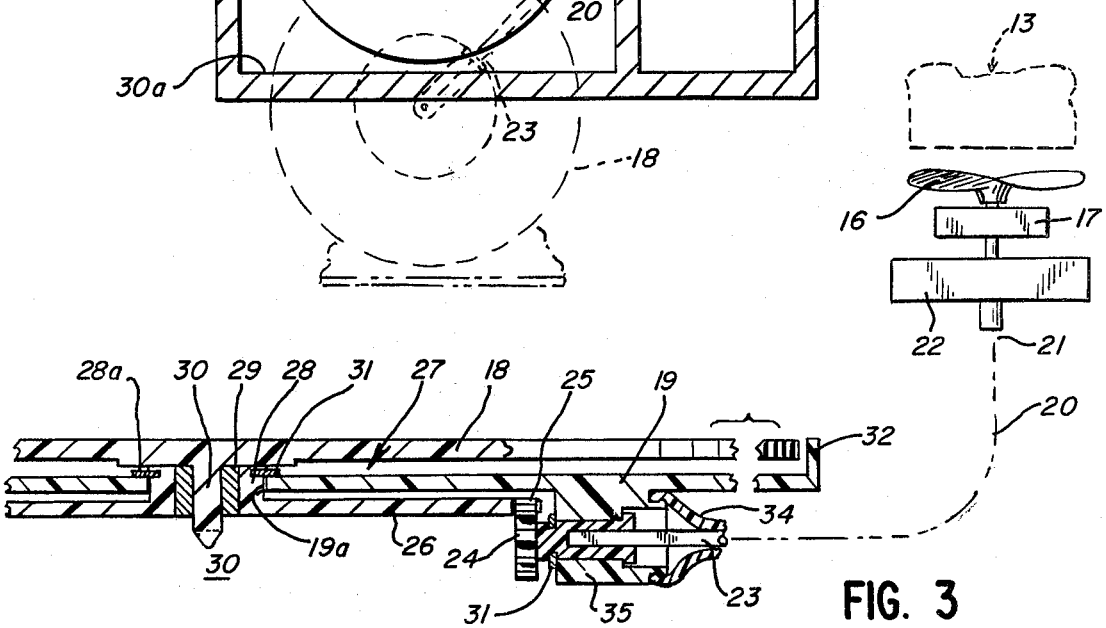
FIG. 3

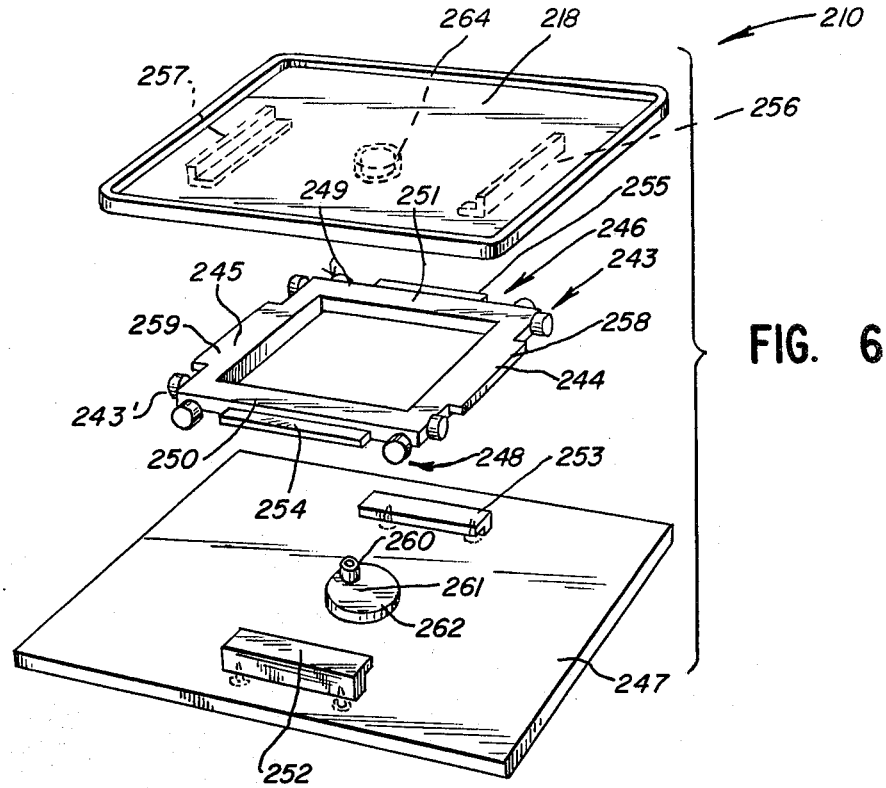
FIG. 6
FIG. 7
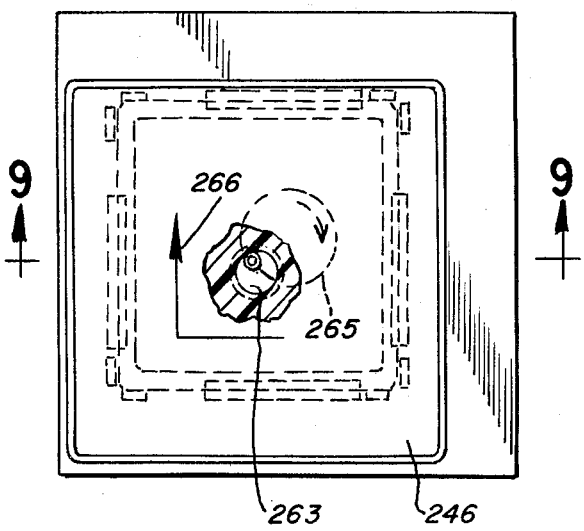
FIG. 8
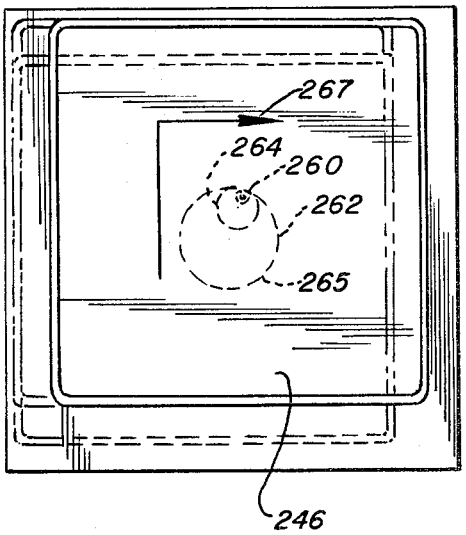
FIG. 9
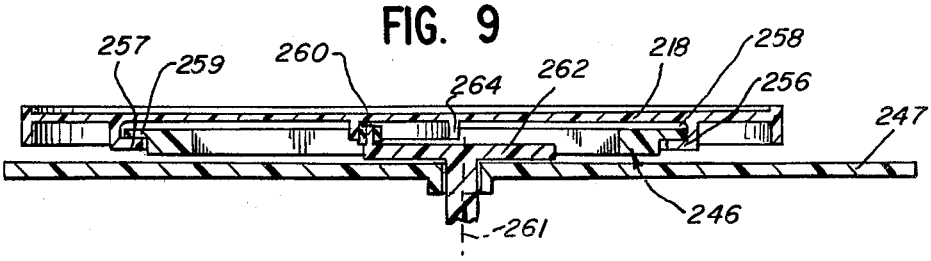

TURNTABLE DRIVE FOR A MICROWAVE OVEN

BACKGROUND OF THE INVENTION

1. Field of the Invention

This invention relates to microwave ovens and in particular to means for moving the support during operation of the microwave generating means so as to provide uniform distribution of the microwave energy in the food being heated.

2. Description of the Background Art

In the conventional microwave oven, a microwave energy generator delivers the microwave energy through a wave guide into a top portion of the oven for distribution throughout the oven cavity onto the food to be heated therein. A problem arises in that the distribution of the microwave energy from such a wave guide is not uniform and uneven heating of the food results.

One attempted solution to the problem is to provide a stirrer in the path of the microwave energy as it enters the oven cavity. The stirrer comprises means for reflecting the microwave energy at different angles as the stirrer is rotated in the path of the microwave energy. Another attempted solution to the problem has been to provide a rotatable turntable which is driven during the oven operation so that the food being heated is selectively positioned in different portions of the cavity for receiving the nonuniformly distributed microwave energy therein.

One form of microwave oven having a rotatable turntable is disclosed in U.S. Pat. No. 4,131,778 of Junzo Tanaka et al. As shown therein, a wheel is driven by a belt from a drive motor. The wheel is provided with magnetic coupling means for rotating the rotary table for supporting the food to be cooked in the oven.

In U.S. Pat. No. 4,210,794 of Ichiro Oguri, a microwave oven is shown wherein a drive motor drives a mechanism for rotating the turntable.

Another form of rotatable food heating device is illustrated in U.S. Pat. No. 3,744,403 of John Castronuovo. As shown therein, the appliance is arranged to toast marshmallows by means of a horizontal turntable carrying upright picks which are slowly rotated as the turntable turns so that all sides of the marshmallows are faced to the oven heating element during the toasting operation.

SUMMARY OF THE INVENTION

The present invention comprehends as improved microwave oven structure wherein a flexible shaft is driven at one end from the motor driving the fan for cooling the microwave energy generator. The opposite end of the flexible shaft is connected to a mechanism which moves the food supports during operation of the fan motor to cause uniform distribution of microwave energy to the food carried thereon.

The mechanism effects both lateral translation of the support and concurrent rotation thereof.

The mechanism, in one illustrated embodiment, causes a translation of the support in a substantially straight-sided closed path.

In the illustrated embodiment, the structure further includes means for selectively manually positioning the support for facilitated placement of food thereon and subsequent movement by the shaft-driven mechanism.

The selective positioning means in the illustrated embodiment effectively comprises a one-way clutch connecting the support to the mechanism.

In the illustrated embodiment, the mechanism and support are mounted on a carrier which, in turn, is mounted for selective movement from and into the cavity, with the flexible shaft distal end freely moving therewith.

In the illustrated embodiment, the carrier mounting means comprise a slide means.

The flexible shaft effectively connects the drive motor disposed outside the microwave oven cavity to the turntable support disposed within the cavity and permits a wide range of movement of the support both within the cavity and selectively inwardly and outwardly of the cavity.

The microwave oven structure of the present invention is extremely simple and economical of construction while yet providing a highly improved uniform heating of food in the oven cavity by novel movement of the support means therein.

BRIEF DESCRIPTION OF THE DRAWING

Other features and advantages of the invention will be apparent from the following description taken in connection with the accompanying drawing wherein:

FIG. 1 is a fragmentary perspective view of a microwave oven having an improved driven food support embodying the invention;

FIG. 2 is a fragmentary horizontal sectional illustrating the selective positioning of the turntable within the oven cavity and in a forwardly disposed access position, with the flexible shaft of the drive means illustrated in the different positions assumed in the selective positioning of the turntable;

FIG. 3 is a fragmentary enlarged vertical section taken substantially along the line 3—3 of FIG. 2;

FIG. 6 is a fragmentary exploded view of a modified form of oven structure providing a unique movement thereof in the oven cavity;

FIG. 7 is a plan view illustrating a portion of the path of movement of the support of the embodiment of FIG. 6;

FIG. 8 is a plan view illustrating another portion of the path of movement thereof; and FIG. 9 is a fragmentary vertical enlarged section taken substantially along the line 9—9 of FIG. 7.

DESCRIPTION OF THE PREFERRED EMBODIMENTS

Figure 4:
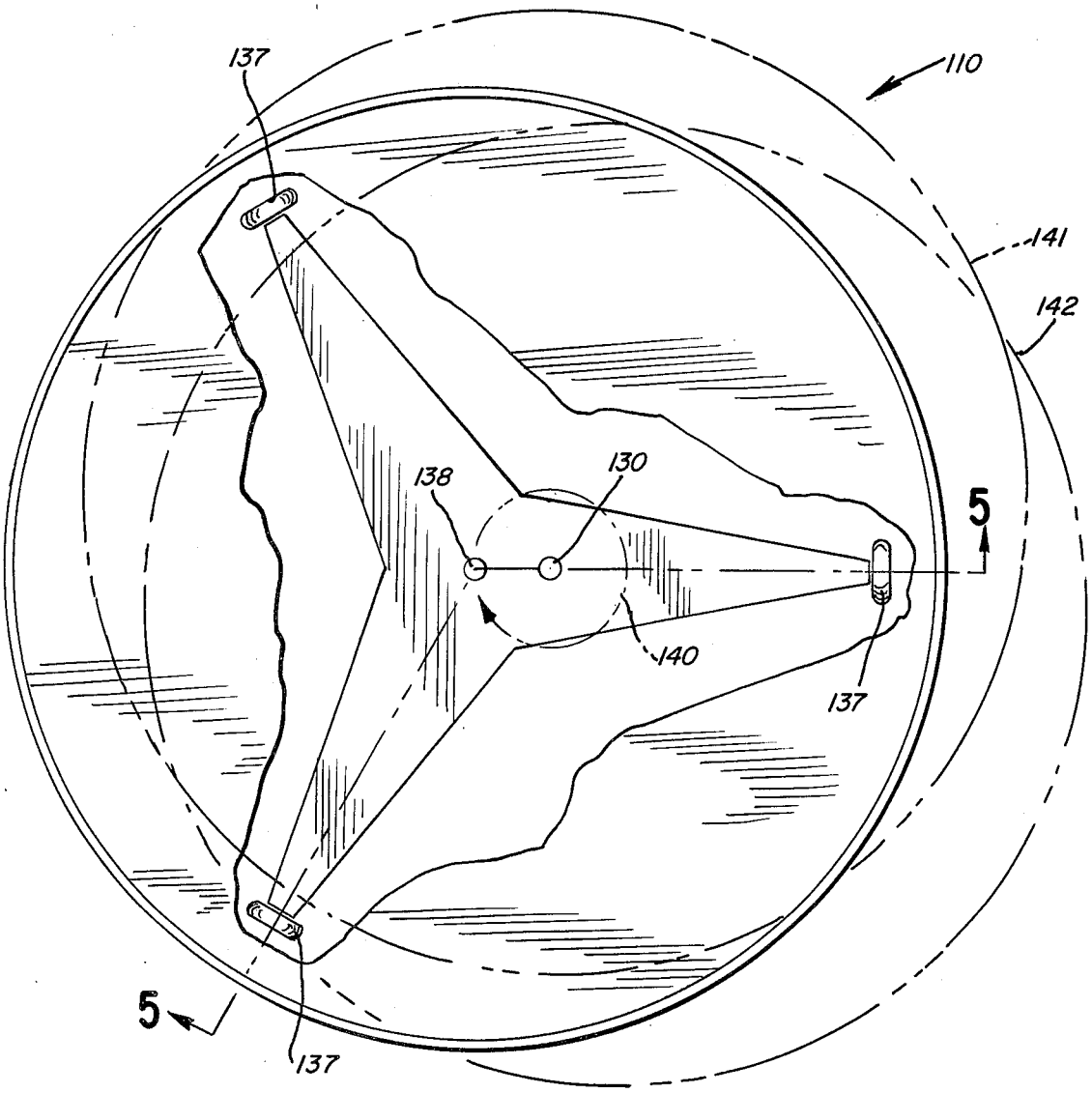
FIG. 4 is a fragmentary top plan view of the turntable with portions broken away.

In the exemplary embodiment of the invention as disclosed in FIGS. 1–5 of the drawing, a microwave oven generally designated 10 is shown to include a cabinet 11 defining an oven cavity 12 in which food products and the like are placed to be heated. Microwave energy is delivered to the oven cavity from a microwave generator generally designated 13 in FIG. 3 of conventional construction housed in a machinery portion 14 of the cabinet. The machinery portion is provided with suitable manual controls, such as control 15, for controlling the operation of the generator in effecting the heating objects placed in the oven cavity.

The apparatus is further provided with a blower, or fan, 16 which is driven by a suitable electric motor 17 for cooling the generator in the operation of the oven.

A food support, or turntable, 18 is provided within the oven cavity for supporting food and the like to be heated by subjection thereof to the microwave energy delivered into the cavity from generator 13 in the normal operation of the oven. As seen in FIG. 1, turntable 18 is mounted to a carrier, or shelf, 19 which is slidably mounted in horizontal guides or mounting means 33 (only one shown) mounted to both sides 12*a* and 12*b* within the oven cavity so that the turntable is selectively disposed in a heating disposition fully within the cavity, as illustrated in full lines in FIG. 2, or in a forwardly disposed access position, as illustrated in broken lines in FIG. 2. In the access position, a lower portion 30 of the oven cavity 12 is exposed. This lower portion provides for microwave propogation through the lower side of the tray 19 into the food supported thereon and also houses drive mechanism 27 depending from the turntable as hereinafter explained. The turntable is accessible to the user for facilitated placement of food products and the like on the turntable in the access position as best seen in FIG. 1. As illustrated in FIG. 1, the side edges 32 of the carrier are slidably received in the channel like guides 33 for facilitated selective disposition of the carrier. Because the drive mechanism depends from the tray 19 into lower portion 30, the tray is not extendable out of the cavity beyond the position shown wherein the depending mechanism 27 contacts a front wall 30 of the lower cavity portion.

The invention comprehends a novel means for driving the turntable so as to rotate the turntable during the heating operation. More specifically, as best seen in FIG. 3, the turntable 18 is driven by means of a flexible shaft, or sheathed cable, 20, preferably nonmetallic, having one end 21 connected to a speed-reducing gear unit 22 which, in turn, is driven by the fan motor 17. The other or distal end 23 of the flexible shaft is connected by conventional means for corotation with a drive gear 24 which meshes with peripheral teeth 25 of a drive plate 26 of a drive mechanism generally designated 27.

A hub portion 28 of a drive plate 26 extends through an opening 19*a* in shelf 19. Mounted in the hub portion 28 of the drive plate 26 is a one-way clutch 29 of conventional construction, to which is connected a depending pin 30 of the turntable 18. A snap ring or the like device 28*a* retains the hub portion 28 in opening 19*a* of carrier 19. The turntable is slidably supported on the hub portion 28. As best seen in FIG. 3, the edges 32 of the carrier extend upwardly to adjacent the upper surface of the turntable so that the turntable is effectively recessed in the carrier.

As further shown in FIG. 3, the distal end 23 of the flexible shaft is mounted to the carrier by means of a connector 34 which underlies the carrier and engages a depending boss 35 on the carrier. The connector 34 may be formed as an integral part of the cable sheath. Thus, as seen in FIG. 2, the flexible shaft distal end 23 moves with the carrier between the heating and access positions, with the flexible shaft freely accommodating this movement. Connector 34 secures the distal end of the shaft to the carrier so that a positive engagement is maintained between the shaft 23 and gear 24. A snap ring 31 maintains the relative engagement of the tooth edge portion 25 of the gear plate 26 with drive gear 24.

One-way clutch 29 permits the user to rotate the turntable when in the access position to facilitate placement and removal of the food product on the turntable.

When the turntable is returned to the full line position of FIG. 2 inside the oven cavity 12 and upon movement of the cabinet door D to the closed position thereacross, control 15 may be operated to effect energization of the generator and initiation of the heating operation. At this time, the operation of fan motor 17 is automatically initiated so that the turntable is driven through the flexible shaft 20 to effect improved uniform heating of the food product placed on the turntable.

Figure 5:
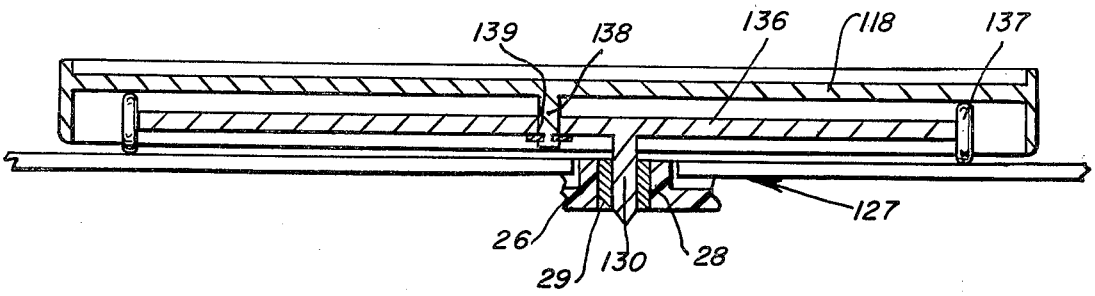
FIG. 5 is a fragmentary vertical section taken substantially along the line 5—5 of FIG. 4.

Referring now to the embodiment of FIGS. 4 and 5, a microwave oven structure 110 includes a modified form of mechanism generally designated 127 for driving a turntable 118 is shown to comprise an intermediate table 136 provided with a drive pin 130 driven through one-way clutch means 29 by hub portion 28 of the gear plate 26. The intermediate table is provided with suitable peripheral wheels 137 on which the turntable 118 rests. As further illustrated in FIG. 5, the turntable is provided with a depending central post 138 extending through an opening 139 in the center of the intermediate table 136. Pin 130 is spaced radially from the post 138 and, thus, the turntable is caused to concurrently rotate about the axis of pin 130 while revolving thereabout as a result of the eccentric disposition of the connecting post 138 relative to the axis of pin 130. This action is best seen in FIG. 4 wherein the broken circle 140 illustrates the path of movement of the post 138 about the axis of the pin 130. The resultant eccentric movement of the turntable is illustrated in broken lines 141 and 142 in FIG. 4.

Referring now to the embodiment of FIGS. 6–9, a microwave oven structure 210 includes a food support 218 comprising a rectangular tray. The tray is movably supported on two pairs of rollers 243 and 243' at the side edges of 244 and 245 of a wheel frame generally designated 246.

Frame 246, in turn, is supported on a shelf or carrier 247 slideable in horizontal guides 33 by two additional pairs of rollers 248 and 249 at the front edge 250 and rear edge 251, respectively, of the frame.

Shelf 247 is provided with a pair of spaced, parallel, upstanding L-shaped guides 252 and 253, which cooperate with complementary projecting slides 254 and 255 on the front edge 250 and rear edge 251 of the frame 246 to define a guide means for limiting the movement of the frame 246 to a reciprocal movement parallel to the front edge 250 and rear edge 251 of the frame. Thus, the wheel frame 256 acts as a truck for carrying the table support 218 for transverse reciprocal movement on the baseplate 247 in an effectively rectilinear transverse path.

As further seen in FIG. 6, support 218 is provided with a pair of depending L-shaped guides 256 and 257 which cooperate with projecting slides 258 and 259 on the side edges 244 and 245, respectively, of the truck frame 246 to define guide means for limiting movement of the support plate 218 to reciprocal movement parallel to the longitudinal extent of the side edges 244 and 245 perpendicular to the movement of the truck frame on the baseplate, as discussed above.

Movement of the support plate in the oven cavity is effected by the revolution of a crank pin 260 about the rotational axis 261 of a crank 262. The crank pin projects into a downwardly opening recess 263 defined by an annular wall 246 depending from the underside of the support plate 218. The crank pin 260 comprises a roller which rolls about the inside surface of the annular wall, as shown in FIGS. 7, 8 and 9. The path of movement of the roller crank pin 260 is illustrated in the broken line circle 265 of FIGS. 7 and 8. As the movement of the truck frame 246 is constrained by the cooperating guides 252, 253 and slides 254 and 255, and the movement of the support plate on the truck frame is constrained by the coaction of the guides 256 and 257 and slides 258 and 259, the movement of the support plate relative to the baseplate 247 is effectively polygonal, and more specifically, as shown in FIGS. 7 and 8, defines a square movement path, as illustrated by the arrows 266 in FIG. 7 and 267 in FIG. 8.

Thus, a large object, such as a fowl or the like, to be cooked in the oven cavity may be placed diagonally on the support table 218, with the polygonal movement of the support table effecting uniform heating thereof in a novel and simple manner.

As described before, the rotation of crank 262 may be effected in a manner similar to the embodiment of FIGS. 1, 2 and 3 by connection thereof to the distal end of the flexible shaft for improved facilitated driving of the support table and sliding movement of the shelf 247.

Each of the oven structures 10, 110 and 210 provides an improved table support movement in the oven cavity. Structures of embodiments 110 and 210 which are similar to structures of embodiment 10 are identified by similar reference numerals but 100 respectively higher. Except as discussed above with respect to the modified embodiments 110 and 210, each of the embodiments functions in a similar manner.

The foregoing disclosure of specific embodiments is illustrative of the broad inventive concepts comprehended by the invention.

I claim:

1. In a microwave oven having wall means defining an oven cavity, microwave generator means for delivering microwave energy to said cavity, a motor, a fan driven by the motor for cooling the generator means during operation thereof, and a food support, the improvement comprising:

a flexible shaft having one end driven by the fan motor, and a distal end;

means for movably mounting the support for (a) movably supporting food in the cavity, and (b) disposing the support in an access position at least partially outwardly of said cavity for placement of food on and removal of food from said support; and a mechanism connected to said distal end of flexible shaft for driving about a center position thereof said support during operation of the fan motor, said shaft remaining connected to the mechanism when said support is disposed in said access position while permitting selective positioning of the support in said access position.

2. The microwave oven structure of claim 1 wherein said support mounting means comprises means for permitting lateral translation of the support by said mechanism.

3. The microwave oven structure of claim 1 wherein said support mounting means comprises means for permitting lateral translation of the support by said mechanism concurrently with rotation thereof.

4. The microwave oven structure of claim 1 wherein said support mounting means comprises means for permitting lateral translation of the support by said mechanism in a substantially straight-sided closed path.

5. In a microwave oven having wall means defining an oven cavity, microwave generator means for delivering microwave energy to said cavity, a motor, a fan driven by the motor for cooling the generator means during operation thereof, and a food support, the improvement comprising:

a flexible shaft having one end driven by the fan motor, and a distal end;

means for movably mounting the support for (a) movably supporting food in the cavity, and (b) disposing the support in an access position at least partially outwardly of said cavity for placement of food on and removal of food from said support;

a mechanism connected to said distal end of the flexible shaft for driving about a center position thereof said support during operation of the fan motor to cause uniform distribution of microwave energy to the food carried on said support; and means for permitting selective manual positioning of said support while in said access position for facilitated placement of food thereon and subsequent movement by the shaft-driven mechanism when returned to the cavity.

6. The microwave oven structure of claim 5 wherein said selective positioning means effectively defines a one-way clutch.

7. The microwave oven structure of claim 5 wherein said selective positioning means effectively defines a one-way clutch connecting the support to the mechanism.

8. In a microwave oven having wall means defining an oven cavity, microwave generator means for delivering microwave energy to said cavity, a motor, a fan driven by said motor for cooling the generator means during operation thereof, and a food support, the improvement comprising:

a flexible shaft having one end driven by the fan motor, and a distal end;

means for movably mounting the support for supporting food in the cavity;

a mechanism connected to said distal end of the flexible shaft for driving about a center position thereof said support as an incident of operation of the fan motor to cause uniform distribution of microwave energy to the food carried on said support;

a carrier mounting said mechanism and support;

means for mounting said carrier for selective movement of said support and mechanism from and into said cavity with said flexible shaft distal end freely moving therewith; and means for preventing operation of said mechanism when said support is moved from said cavity.

9. The microwave oven structure of claim 8 wherein said carrier mounting means comprises slide means.

10. The microwave oven structure of claim 8 wherein said shaft distal ends extends under said carrier.

11. In a microwave oven having wall means defining an oven cavity, a microwave generator means for delivering microwave energy to said cavity, a fan motor, a fan driven by said motor for cooling the generator means during operation thereof, and a food support, the improvement comprising:

a flexible shaft having one end driven by the fan motor, and a distal end;

means for movably mounting the support for supporting food in the cavity; and a mechanism connected to said distal end of the flexible shaft for moving said support in a substantially straight-sided closed path during operation of the fan motor to cause uniform distribution of microwave energy to the food carried in said support, said mechanism including a baseplate, a rectangular truck member having parallel front and rear edges and parallel side edges, a pair of wheels at each of said edges, cooperating guides on said baseplate and truck member for guiding said truck member for wheeled movement on said baseplate reciprocally parallel to said front and rear edges by the wheels at said front and rear edges, cooperating guides on said truck member and support for guiding said support for movement on said truck member reciprocally parallel to said side edges by the wheels at said side edges; and means driven by said distal end for urging said support to move in a path permitted by said guides and wheels.

12. The microwave oven structure of claim 11 wherein said guides comprise rectilinear slide elements.

13. The microwave oven structure of claim 11 wherein said support urging means comprises a force member driven in a circular path and engaging a reaction member on the support defining an annular wall having a diameter smaller than the diameter of said path.

14. The microwave oven structure of claim 11 wherein said support urging means comprises an upright force member driven in a circular path and engaging a reaction member on the underside of the support defining an annular wall having a diameter smaller than the diameter of said path.

* * * * *